United States Patent [19]

Bishop

[11] 3,998,479

[45] Dec. 21, 1976

[54] DUAL CONDUIT DRILL STEM MEMBER AND CONNECTION

[75] Inventor: William W. Bishop, Midland, Tex.

[73] Assignee: Smith International, Inc., Midland, Tex.

[22] Filed: Dec. 23, 1974

[21] Appl. No.: 535,373

[52] U.S. Cl. ..... 285/133 A; 285/351; 285/381; 285/332.2

[51] Int. Cl.[2] ..... F16L 47/00

[58] Field of Search ..... 285/133 R, 133 A, 138, 285/140, 381, 347, 351, 332.2, 332.3

[56] References Cited

UNITED STATES PATENTS

| | | | |
|---|---|---|---|
| 341,713 | 5/1886 | Young | 285/351 X |
| 626,932 | 6/1899 | Reed et al. | 285/351 |
| 762,777 | 6/1904 | Vernon | 285/351 X |
| 2,850,264 | 9/1958 | Grable | 255/28 |
| 3,208,539 | 9/1965 | Henderson | 285/133 A X |
| 3,265,091 | 8/1966 | De Jarnett | 138/114 |
| 3,471,177 | 10/1969 | Garrett et al. | 285/133 R |
| 3,552,779 | 1/1971 | Henderson | 285/133 R |
| 3,552,779 | 1/1971 | Henderson | 285/133 |
| 3,664,441 | 5/1972 | Carey | 285/133 A |

*Primary Examiner*—Wayne L. Shedd
*Attorney, Agent, or Firm*—Murray Robinson; Ned L. Conley

[57] ABSTRACT

When adjacent pipes are made up by tool joints on outer tubes of dual conduit drill pipe, radially spaced pin and box on inner tubes shrink fitted in tool joints are sealed by bullet shaped seal rings around pin and in box compressed against shoulders and almost enclosed.

9 Claims, 9 Drawing Figures

Fig. 2A
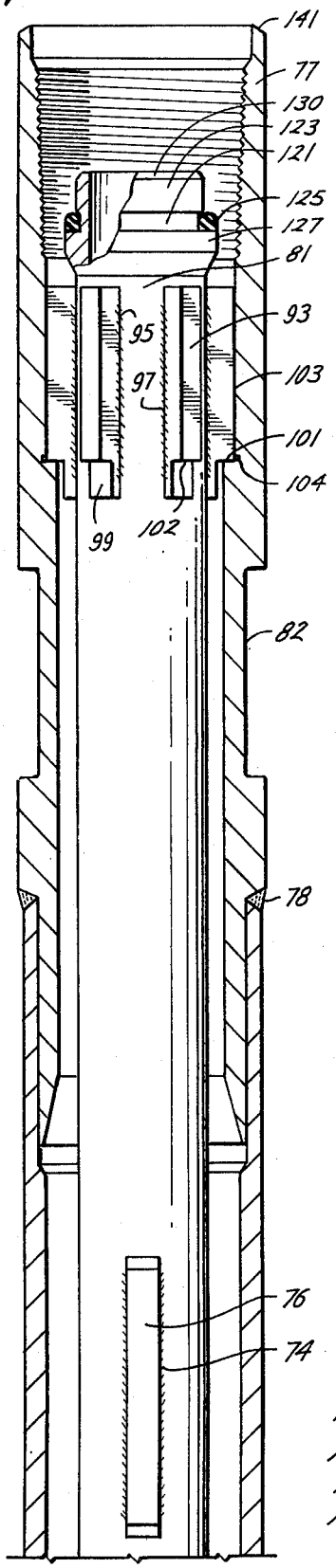
Fig. 2B
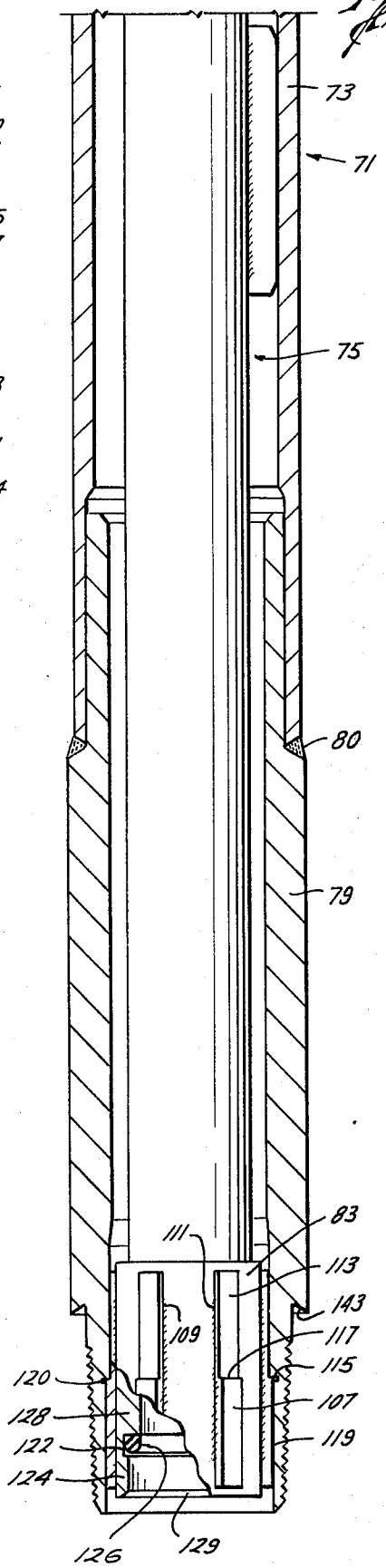
Fig. 9
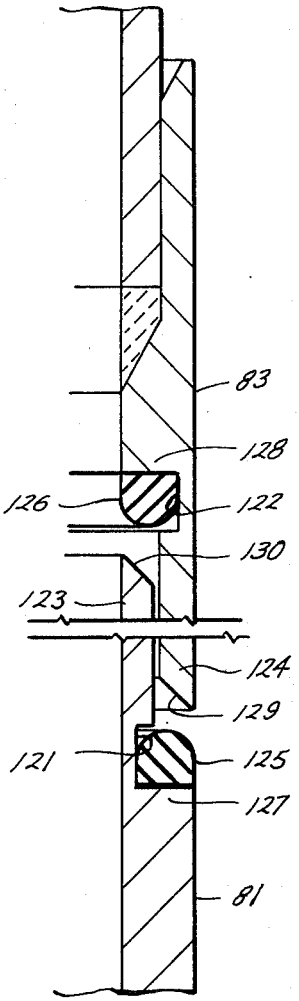
Fig. 8

DUAL CONDUIT DRILL STEM MEMBER AND CONNECTION

BACKGROUND OF THE INVENTION

This invention pertains to pipe connections and more particularly to pipe connections for dual conduit drill stem members each comprising a drill pipe having a tube therein radially positioned to form an annular flow passage therebetween, the tube providing a second flow passage therewithin.

A principal requirement for dual conduit drill stem is maintenance of the seals between adjacent drill stem members so that there is no short circuiting of the two fluid paths through the drill stem. Especially in the case of drilling with an aeroform, i.e. elastic, fluid, it is important to maintain separation of the fluid paths since any leakage from one or the other drops the fluid pressure materially, resulting in greatly diminished flow to the bit at the bottom of the drill stem. In any case, a slight leak soon cuts out a large leak path requiring discontinuance of drilling until the leak is repaired. This problem has been substantially solved in single conduit drill stem by the use of rotary shouldered connections.

Applicant's assignee has heretofore constructed dual conduit drill stem employing rotary shouldered connections for the pipe and telescopic connectors with sliding O-ring or flat ring seals for the tube. An example of this construction is shown in FIG. 1 of the present application.

Some difficulty has been experience with the use of dual conduit drill stem members employing sliding seals for the telescopic tube connectors. First of all, the seal rings tend to move out of their retention grooves when an effort is made to make a conection and during the drilling operation. In addition, after a certain amount of useag, leaks develop. This may be due to the fact that when a connection is made there must be relative axial and rotational movement between the connector carrying the seal, be it the pin or box connector, and the other connector. During such movement the seal-ring may be abraded by sand or other hard particles carried by the connector sliding past it. In addition, the tolerances on the diameters of the connectors required to effect a sliding seal are quite small, so that wear on the connectors may soon result in leakage. If there is lack of concentricity, the telescoping metal members may touch and fret, producing a rouch surface which will wear out the O-ring seal during make up and break out of the connection.

SUMMARY OF THE INVENTION

According to the invention there is provided a dual conduit drill stem member similar except for the tube connectors to the aforementioned construction of applicant's assignee shown in FIG. 1 hereof, such drill stem member comprising a length of drill pipe having pin and box steel tool joints at its ends. The tool joints provide means to make rotary shouldered connections with correlative members on adjacent drill stem members, each tool joint having an outwardly facing internal shoulder and an internal cylindrical shrink fit area. A length of tube inside the drill pipe is radially positioned therein by spacers welded or in other manner attached to the outside of the tube at intervals along the length thereof and circumferentially staggered around its outer periphery. The tube is provided at its ends with pin and box double butt connectors. A pin connector for one end of the tube is provided with centralizer means such as a plurality of circumferentially spaced fins on its exterior. The pin connector's centralizer means also serves as tube retention means, being shrink fitted within the shrink fit area of one of the drill pipe tool joint members, preferably the box, with the centralizer means abutting the box's internal shoulder. A box connector for the other end of the tube is provided with centralizer means such as a plurality of circumferentially spaced fins on its exterior. The box connector's centralizer means also serves as tube retention means, being shrink fitted within the shrink fit area of the other of the drill pipe tool joint members, preferably the pin, with the centralizer means abutting the pin's internal shoulder.

According to a principal feature of the invention the box connector has an annular internal shoulder facing the box's outer end and an annular internal seal retention groove adjacent the shoulder between the shoulder and the box's outer end. In the box connector's seal retention groove is a compliant, preferably elastomeric, e.g. rubber seal ring which extends inwardly over the box's internal shoulder. The pin connector has an annular external shoulder facing the pin's outer end and an annular external seal retention groove adjacent the shoulder between the shoulder and the pin's outer end. In the pin connector's seal retention goove is a compliant, preferably elastomeric, e.g. rubber, seal ring which extends outwardly over the pin's external shoulder.

Preferably the seal rings are of bullet shape cross section, disposed so as to be pointing toward the ends of their respective connectors, the bases of the bullet shape cross sections lying against the respective shoulders. The seal rings preferably have a Durometer hardness of between 50 and 75 measured on the Shore A scale.

The tip of the connector pin is externally beveled. The mouth of the connector box is internally beveled. These beveled portions of the connectors initially contact the rounded noses of the bullet cross section seal rings tangentially and press the rubber toward the corners joining each retention groove and the adjoined shoulder. This avoids any cutting of the seal rings during make up.

The same size seal ring is used for both the pin and box connectors, the pin seal ring inner diameter being stretched to fit over the pin and into the retention groove, and the box seal ring outer diameter being collapses to pass inside the box and into the retention groove. This eliminates the need for two sizes of seal rings.

The precise positioning of each of the seal rings, effected by causing the centralizer means of each of the tubing connectors to abut against a shoulder in the corresponding tool joint member, insures that when each drill stem member embodying the invention is made up with another similar drill stem member, a dual compression seal will be effected between the tubing members thereof but without over compression of the seal rings. In the fully made up condition of the drill pipe tool joint members there are narrow gaps between the tube connector pin tip and the tube connector box shoulder, and between the tube connector box mouth and the tube connector pin shoulder. The elastomer material of the seal rings is slightly compressed when the tool joints are fully made up and the elastomer material flows into the aforementioned gaps. A perfect seal is thus assured each time the drill stem members are made up. There is very little relative motion of the tubing connectors and seal rings during make up; depending on the desired compression of the seals and the pitch of the tool joint threads usually less than a full 360° revolution of the drill stem occurs between the initial seal contact and full sealing engagement during make up, and vice versa during breakout. Therefore there is very little seal wear during make up and break out.

Since the seals are of the compression type there is no need for close radial spacing of the pin and box tube connectors, as is the case for sliding seals. According to the invention there is provided adequate radial spacing between the pin and box tube connectors so that tolerances need not be held close to avoid metal to metal contact of the connectors. This avoids fretting of the connectors as occurs often with sliding seal type connectors due to nonconcentricity of the pin and box sufficient to cause metal to metal contact.

According to the invention, both the pin and box tube connectors are firmly connected to the adjacent tool joint members of the drill pipe, so that when the tool joint members are made up fully there can be no relative movement of the pin and box tube connectors and their seal rings, neither axial nor rotational, during operation of the drill pipe. This eliminates seal ring wear such as may occur with other constructions wherein the tube is not firmly connected to the drill pipe at both ends.

The employment of dual seals, one in the box and one on the pin, with seal material extruding out between the gaps between the pin and box, prevents the entrance of drilling fluid and detritus into the space between the tube connector pin and tube connector box during use of the drill stem. This avoids the possibility of damage to the seals that could occur if sand or other abrasive material entered this space and were not cleaned out prior to the next make up of the connection.

Summarizing tube connector sealing is improved by use of dual compression seals to eliminate wear during make up and break out and with the connector pin and box radially spaced to avoid metal to metal contact and fretting, and accurately positioned to extrude the seal material between the axial gaps between the connector pin and box and thereby seal therebetween at both ends, and firmly positioned to avoid relative movement and possible wear during use. With seal life prolonged dual conduit drill stem connections of long life under expected conditions of use are effected.

A further advantage of the present construction, in which the tube is connected at both ends of the drill pipe tool joints, over certain prior constructions in which the tube is secured to the drill pipe only at one end, lies in the fact that the tube shares torsion and both compression and tension axial load with the drill pipe. The load division between the pipe and tube depends upon their thicknesses and materials and initial conditions. Under certain circumstances of expected severe conditions of use, it may be desirable to employ a special composite steel-rubber coupling in the tube somewhere between the tube connectors, e.g. as described in the concurrently filed copending application of Wallace F. Olson, Ser. No. 535,193 entitled Dual Contuit Drill Stem, the disclosure of which is incorporated herein by reference. The present invention wherein both ends of the tube are firmly secured to the drill pipe tool joints using and compression seals is applicable to such construction as well. Although the dual compression seal of the invention is particularly advantageous in combination with the herein described drill stem construction in which the tube connectors are both rigidly connected to their respective tool joints, the dual compression seal might also under some circumstances be used to some advantage with other drill stem constructions, including those in which the tube is not rigidly connected to the pipe at both ends, i.e., is free at one or both ends.

BRIEF DESCRIPTION OF THE DRAWINGS

For a detailed description of a preferred embodiment of the invention, reference will now be made to the accompanying scale drawings wherein:

FIGS. 2A and 2B, hereinafter referred to collectively as FIG. 2, show an axial section through a 3-½ inch outer diameter fabricated drill stem member embodying the present invention;

FIGS. 8 and 9 are cross sections through the seal rings used in the construction of FIG. 3.

DESCRIPTION OF A CERTAIN PRIOR ART CONSTRUCTION

Figure 1:
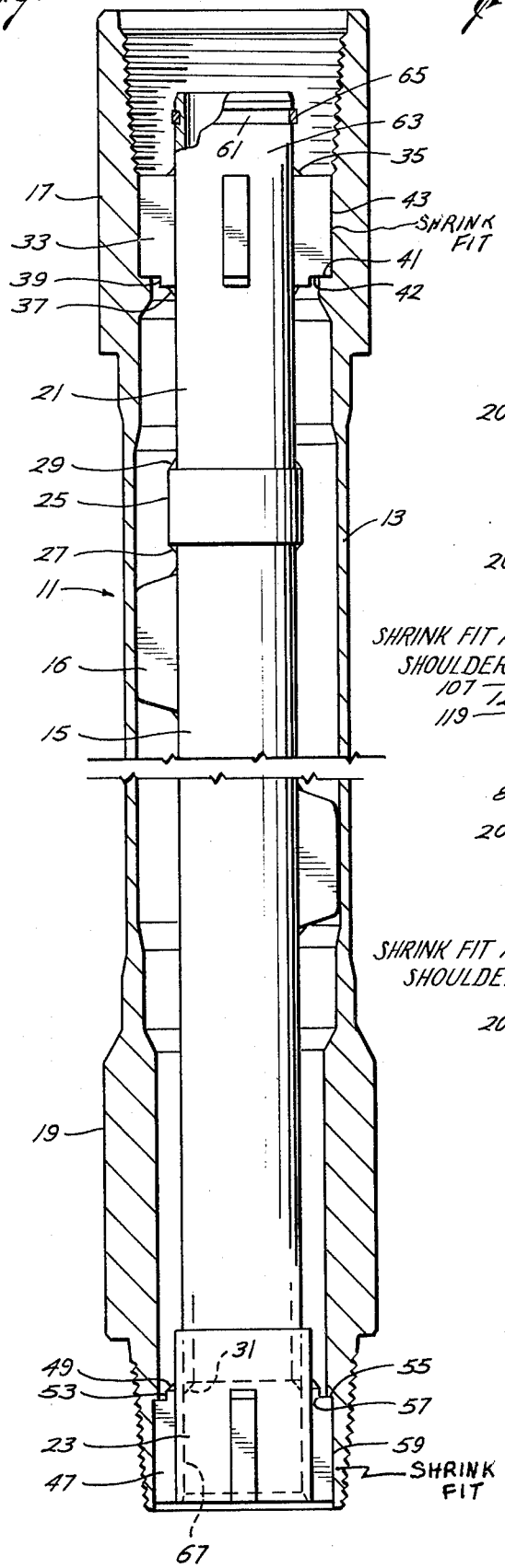
Fig. 1 PRIOR ART
FIG. 1 is an axial section through a prior art drill stem member constructed by applicant's assignee.

Referring now to FIG. 1 there is shown a prior art drill stem member 11 constructed by applicant's assignee, upon which the present invention is an improvement. All parts are steel except for an elastomer seal ring.

Drill stem member 11 comprises a length of drill pipe 13 within which is disposed a tube 15. Radial lugs 16 welded at intervals along tube 15 space the tube from the pipe. At one end of the pipe 13 there is a box tool joint member 17. At the other end of the pipe 13 there is a pin tool joint member 19. Tool joint members 17 and 19 are threaded interiorly and exteriorly, respectively, for making connection with correlative tool joints on adjacent members of a drill stem. Tool joints 17 and 19 are unitized with the ends of the pipe by welding.

At one end of tube 15 there is a pin connector 21. At the other end of the tube 15 there is a box connector 23. The pin connector 21 is connected to tube 15 by means of collar 25 welded to the tube at 27 and welded to the connector at 29. Box connector 23 is connected to tube 15 by being placed over the adjacent end of the tube and by welding at 31.

A plurality of circumferentially spaced radial fins 33 are welded at 35, 37 to the outer periphery of pin connector 21. Each fin 33 is notched at 39 to receive tool joint annular shoulder 41 engaging shoulder 42 of the fin. There is an interior finished shink fit area 43 on the box tool joint member 17 which is shrink fitted onto the fins 33. The pin connector 21 is thus firmly secured to box tool joint member 17.

A plurality of circumferentially spaced radial fins 47 are welded at 49 to the outer periphery of box connector 23. Each fin 47 is notched at 53 to receive tool joint annular shoulder 55 engaging shoulder 57 of the fin. There is an interior finished shrink fit area 59 on the pin tool joint member 19 which is shrink fitted onto fins 47. The box connector 23 is thus firmly secured to the pin tool joint member 19.

There is an annular groove 61 around pin 63 of pin connector 21. Within groove 61 is disposed an elastomeric seal ring 65 of flat rectangular cross-section. Box 67 of box connector 23 is adapted to slip over pin 63 and slidingly engage seal ring 65.

During manufacture of drill stem member 11, tube 15 with pin connector 21 attached is inserted into pipe 13 through the box end of the pipe. The box tool joint member is heated to cause it to expand and receive the fins 33. The tube is pushed into pipe 13 until shoulders 42 on the pin connector fins 33 engage shoulder 41 in the box tool joint 17. The pin tool joint 19 is heated to cause it to enlarge to receive fins 47 of box connector 23. The box connector is then placed on the adjacent end of tube 15 and moved axially until the shoulders 57 on fins 47 engage shoulder 55 inside the pin tool joint member. The box connector is then welded to the tube as is shown at 31.

The lugs 16 are circumferentially staggered around tube 15 as well as spaced axially along the length of the tube. The lugs extend radially from the axis of the tube a somewhat greater distance that the distance from the axis of the pipe to the inner periphery of the pipe. When the tube is assembled in the pipe, the lugs decentralize the pipe. The resulting bending moment causes the lugs to be wedged tightly against the inside of the pipe.

DESCRIPTION OF PREFERRED EMBODIMENT

Drill Stem Member

Referring now to FIG. 2 there is shown a drill stem member 71 according to the invention. All of the parts are preferably made of steel except for the two elastomeric seal rings hereinafter described.

Drill stem member 71 comprises a length of drill pipe 73 within which is disposed a tube 75. Axially separated and circumferentially staggered lugs 76 are secured to tube 75 by axially extending welds 74. The lugs space the tube radially from the pipe. Preferably, though not necessarily, the radial extent of each lug from the tube axis exceeds the pipe inner radius, thereby disposing the tube off-axially within the pipe, the resultant bending of the tube pressing the lugs tightly against the inside of the pipe. At one end of the pipe 73 there is a box tool joint member 77, secured thereto at 78 by a tang weld. At the other end of the pipe 73 there is a pin tool joint member 79 secured thereto by a tang weld 80. Pin tool joint member 79 is provided with an external shoulder 143 to provide a stop and seal to engage the mouth 141 of the box on the box tool joint members. Tool joint member 77 and 79 are threaded interiorly and exteriorly respectively, for making connection with correlative tool joints on adjacent members of a drill stem. Box tool joint 77 is provided with a plurality of flats 82 adapted to receive a wrench to assist in full make up of the connection.

Figure 3:
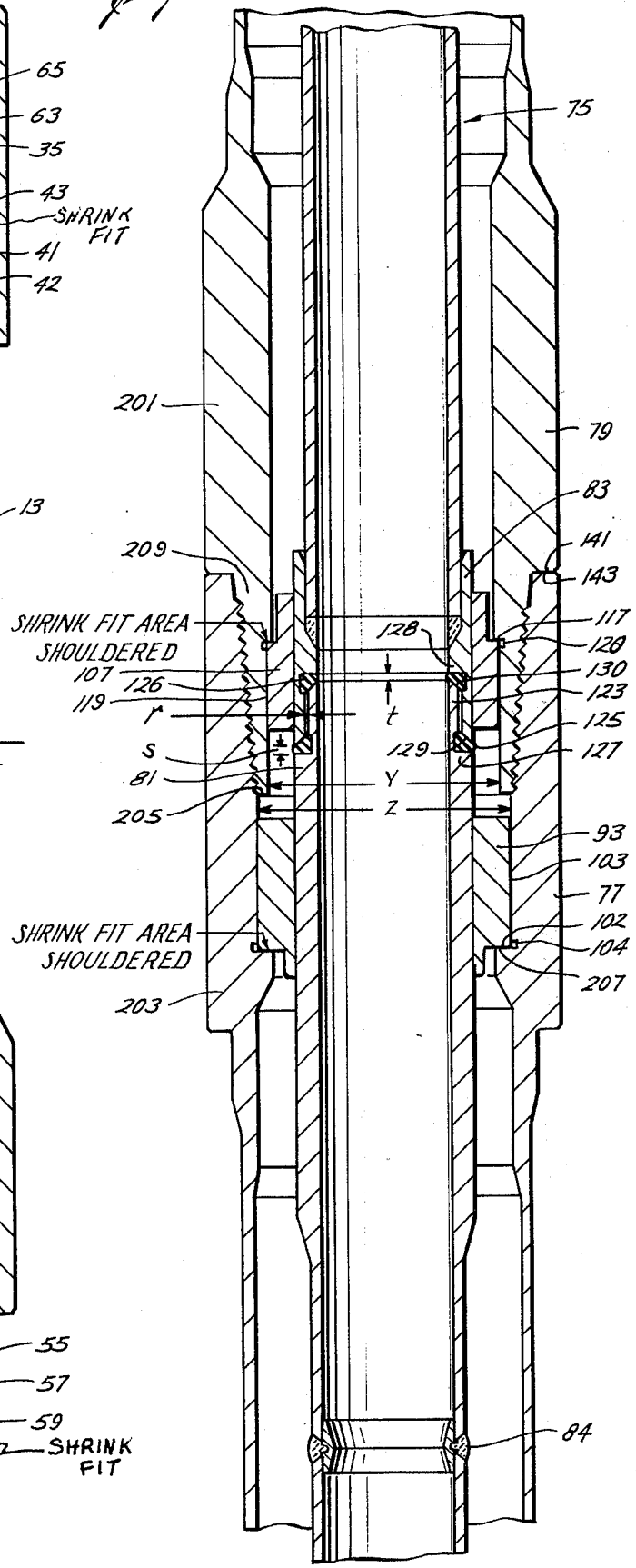
FIG. 3 is an axial section through the connection between the ends of two adjacent drill stem members embodying the invention, the drill stem members being substantially the same as that of FIG. 2 except that the joints of the FIG.2 construction are not unitized with the drill pipe in the manner of FIG. 3 and the FIG. 3 construction is for 6-⅝ inch outer diameter drill pipe with 3inch inner diameter inner tube; like parts in FIGS. 2 and 3 are given like reference numbers.
Figure 5:
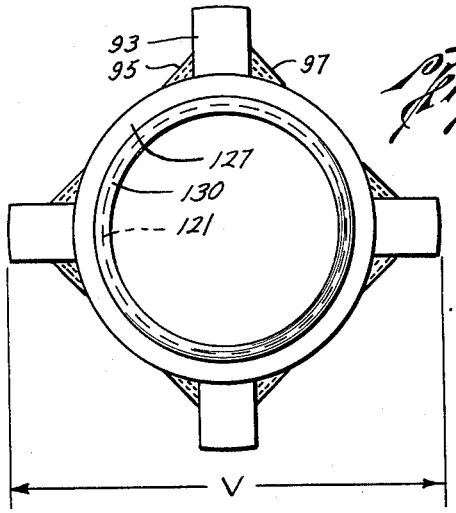
FIGS. 4 and 5 are respectively an axial section and an end view of a pin tube connector forming part of the FIG. 3 construction.
Figure 7:
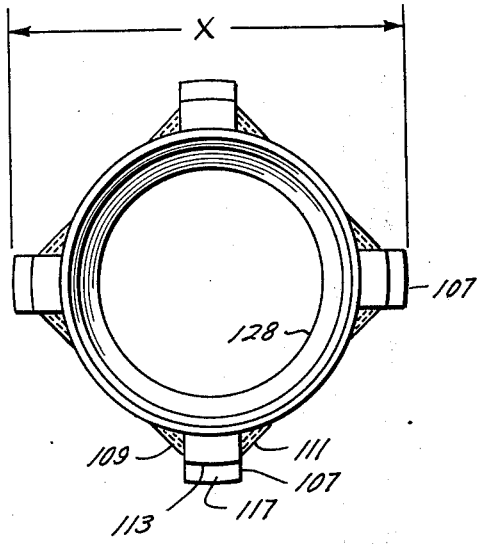
FIGS. 6 and 7 are respectively an axial section and an end view of a box tube connector forming part of FIG. 3 construction.
Figure 4:
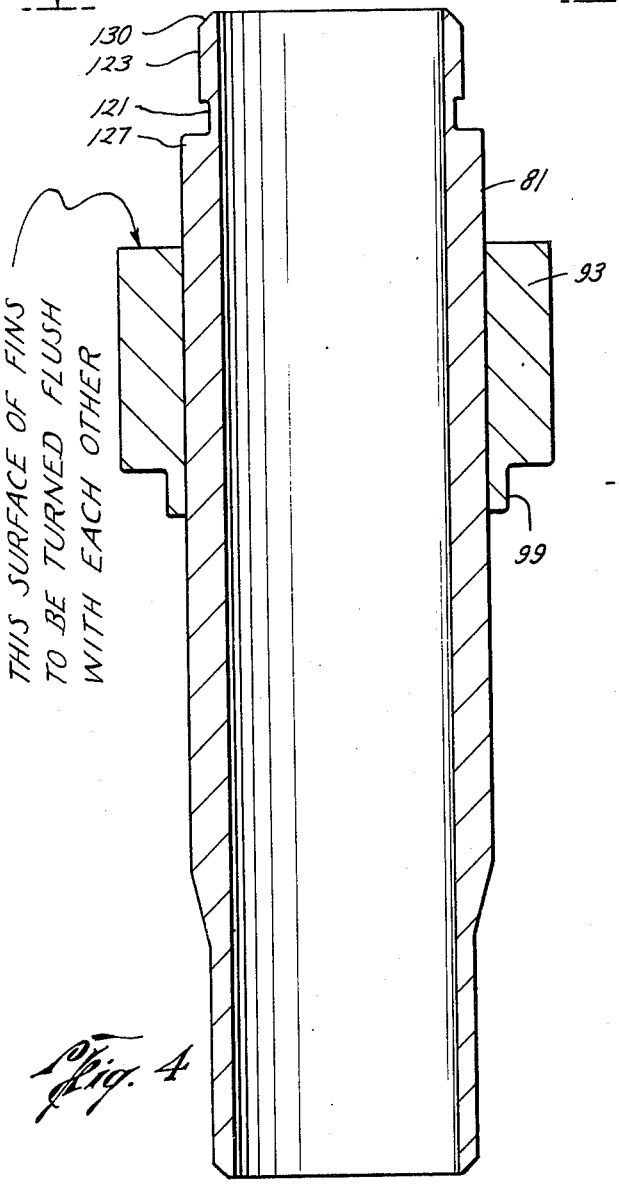
Figure 6:
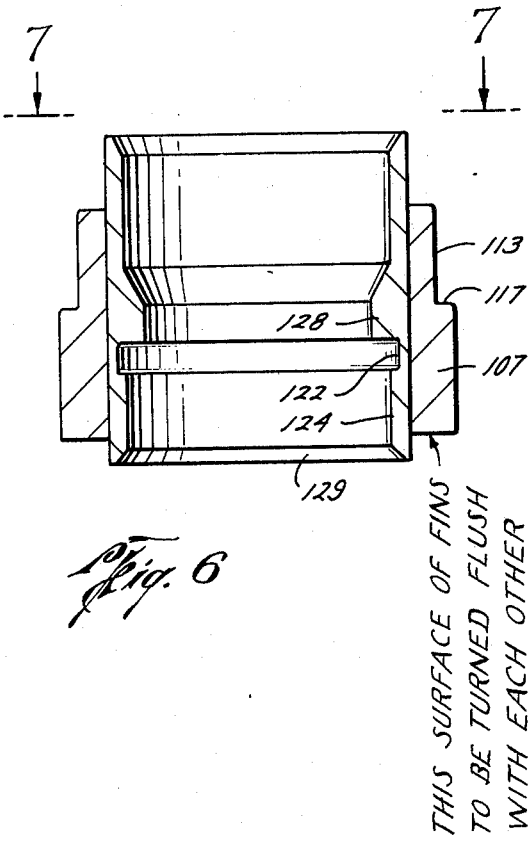

Instead of attaching the tool joints to the pipe by tang welds, they can be unitized therewith, e.g. by flash welding or friction welding, as in the slight modification shown in FIG. 3.

Referring now to both FIG. 2 and FIGS. 3 through 7, at one end of tube 75 there is a pin connector 81. At the other end of the tube 75 there is a box connector 83. The pin connector 81 may be connected to the tube by any suitable means, such as a ferrule weld as shown at 84 in FIG. 3, or may be formed by adaptation of an integral end portion of the tube as shown in FIG. 2. Box connector 83 is connected to tube 75 by being placed over the adjacent end of the tube and by tang welding thereto as will be described hereinafter.

A plurality of circumferentially spaced radial fins 93 are welded at 95, 97 to the outer periphery of pin connector 81. Each fin is notched at 99 to receive tool joint annular shoulder 101 engaging shoulder 102 of the fin. There is an interior finished shrink fit area 103 on the box tool joint member 77 which is shrink fitted onto the fins 93. The pin connector 81 is thus firmly secured to the box tool joint member 77. An annular groove 104 adjacent tool joint shoulder 102 provides stress relief.

A plurality of circumferentially spaced radial fins 107 are welded at 109, 111 to the outer periphery of box connector 83. Each of the fins is notched at 113 to receive tool joint annular shoulder 115 engaging shoulders 117 of the fin. There is an interior finished shrink fit area 119 on the pin tool joint member 79 which is shrink fitted onto fins 107. The box connector 83 is thus firmly secured to the pin tool joint member 79. An annular groove 120 adjacent the tool joint shoulder provides stress relief.

The FIG. 2 apparatus thus far described is generally the same as that of the prior art construction described in relation to FIG. 1, and the method of assembly is generally the same as that previously described. The particular features of the present invention will next be described.

Double Compression Seal

There is an annular groove 121 around pin 123 of pin connector 81. Within groove 121 is disposed an elastomeric seal ring 125. Groove 121 is adjacent to protuberant annual shoulder 127 whereat pin 123 joins the remainder of pin connector 81. The portion of seal ring 125 nearest shoulder 127, which may be called the base portion of the seal ring, is of rectangular cross section, and lies flat againt protuberant shoulder 127. The portion of seal ring 125 nearest the end of pin 123, which may be called the nose portion, is of rounded semi-circular cross section. The cross-section of the seal ring is thus bullet shaped pointing toward the end of connector 81. Box 124 of box connector 83 is adapted to pass over pin 123 and the flaring mouth 129 of the box connector is adapted to abuttingly engage seal ring 125. The initial contact is tangential to the nose of the seal ring.

In similar fashion there is an internal groove 122 in box 124 of box connector 83. Within groove 122 is disposed a bullet cross section elastomeric seal ring 126. The rectangular cross section base portion of the ring lies flat against protuberant shoulder 128. The rounded semi-circular cross section nose portion of the ring points toward the end of box connector 83. Where pin 123 enters box 124, the tapered tip 130 of pin 123 of the pin connector is adapted to abuttingly engage seal ring 126. The initial contact is tangential to the nose of the seal ring.

The elastomeric seal rings 125, 126 preferably have a Durometer hardness of about 65 measured on the Shore A scale, e.g. in the range of 50–75. They each are compressed axially about one-half their axial extend when the tool joint connection is fully made up. The actual value of the compression of the seal ring will depend on its size but may for example be of the order of 0.1 inch on the average. The Compression occurs because in the uncompressed state the axial extent of the protubrant portion of each seal ring, i.e. the portion that protrudes radially from the groove, which is only slightly less than the width of the groove in which it is placed, exceeds on the average the spacing between the adjacent shoulder on the connector and the end of the correlative connector when fully made up. This average is made up of an average of the minimum distance s or t, between the connector shoulder and adjacent connector end, and zero, since the connector box mouth and connector pin tip at their minimum axial extents, scarcely compress the seal at all.

Predetermined Seal Compression and Flow

Pin and box tool joint members 79 and 77 are adapted to make rotary shouldered connections with correlative tool joint members on adjacent drill stem members. Make up is limited by engagement of the stop surfaces provided by the tool joint box shoulder 141 and tool joint pin shoulder 143. In FIG. 2 these shoulders are shown as flaring from pin toward box but reverse flares could be used. In FIG. 3 square shoulders are employed. Full make up occurs a certain fraction of a turn after engagement of shoulders 141, 143, depending on the preselected torque applied during make up.

Referring now particularly to FIG. 3, when a pin tool joint member 79 on one drill stem member is made up fully with a box tool joint member 77, the mouth 129 of the box connector 83 is somewhat spaced at *0300 s* from the protuberant shoulder 127 on the pin tubing connector 81. This permits elastomer seal ring 125 to flow into the annular space, thereby preventing over-compression of the seal ring 125.

In the fully made up condition of the tool joints, as above described, the top 130 of pin 123 of the pin tube connector 81 is somewhat spaced at *t* from the protuberant shoulder 128 on the box tube connector 83 to permit elastomer seal ring 126 to flow into the annular space, thus preventing over-compression of seal ring 126.

Sealing Off Connector Pin and Box Annulus

Flow of elastomer ring 125 into space *s* prevents entrance, into the annular space *r* between the tube connectors' box and pin, of fluid and detritus from the annulus between the drill pipe and tubes of drill stem.

Flow of elastomer seal ring 126 into space *t* prevents entrance, into the annular space *r* between the tubing connector's box and pin, of fluid and detritus from inside the tubes of the drill stem.

Radially Spaced Connector Pin and Box

By excluding fluid and detritus from the space *r* between the connectors' pin and box, the seal rings 125, 126 are protected against damage without the need for cleaning them off prior to each make up.

The outer periphery of pin 123 is radially separated from the inner periphery of the box 124 by a distance *r* which is of the order of 0.050 inch or more. This is much greater than the separation of telescopic members with sliding seals, the latter being of the order of 0.005 inch. This large separation avoids any metal to metal contact there during make up of the connection between two drill stem members and avoids fretting during use of the drill stem. This avoids roughening of the metal surfaces, especially at the pin tip 130 and box mouth 129, which could damage the seal rings 125, 126. The 0.050 inch separation is large enough to receive without damage to the pin and box surface particles of at least 0.050 inch maximum transverse dimension.

Concentric Connector Pin and Box

Since the box tube connector 83 and the pin tube connector 81 are both firmly anchored in the drill pipe pin and box tool joints 79, 77, respectively, they are maintained concentric, which further reduces the possibility of metal to metal contact of the pin 123 and box 124 of the tube connectors 81, 83. This not only reduces possible damage to the metal surfaces but assures proper abutting sealing engagement of the tube connector pin 130 tip and the tube connector box mouth 129 with the axial compression seal rings 125, 126. In the case where spacer lugs 76 act as decentralizers to create bending of the tube 75 and wedging of the lugs 76 against the pipe 73, the tight shrink fit at 119, 103 around each tube connector 81, 83 is especially important to prevent canting of the tube connectors.

Fixed Axial Positioning

As previously noted, the tool joint stop shoulders 141, 143, accurately position the tube connectors' pin tip 130 and box mouth 129 in axially spaced relationship to the connectors' box and pin shoulders 128, 127, thereby to provide space for elastomer flow. This accurate positioning occurs because the tube connectors 81, 83 are rigidly connected to the tool joints 77, 79 by shrink fitting at 119, 103. Accurate axial positioning of the tool joints 77, 79 by virtue of stop shoulders 141, 143 accurately positions the tube connectors 81, 83 axially. It is also to be noted that since the tube connectors 81, 83 are rigidly connected to the drill pipe tool joints 77, 79, when the tool joints are made up and hence prevented from relative axial movement, the tube connectors 81, 83 cannot move axially relative to each other. This is important since it prevents wear on the seal rings 125, 126 as could occur if the connectors 81, 83 were free to move axially relative to each other. Axial vibration of the connector pin 123 relative to the seal ring 126 carried by the connector box 124 and axial vibration of the connector box 124 relative to the seal ring 125 carried by the connector pin 123 could cause deterioration of the seal rings.

Shrink Fits

Since it is important that the tube 75 be rigidly connected to the pipe 73 at each end, a specific example of the degree of shrink fit between each tool joint and tube connector will be given. The distance X in FIG. 7, the diametral distance between the outer peripheries of the box connector centralizer fins 107 is 5.259 (+0.000 – 0.002) inches. The distance Y in FIG. 3, the inner diameter of the shrink fit area 103 in the tool joint pin, 123 is 5.250 (+0.002 – 0.000) inches. There is thus a nominal diametral interference of 0.009 inches and a minimum diametral interference of 0.005 inches. The distance Z in FIG. 3, the inner diameter of the shrink fit area 119 in the tool joint box 79, is 5.750 (+0.002 – 0.000) inches. The distance V in FIG. 5, the diametral distance between the outer peripheries of the pin connector centralizer fins 93 is 5.759 (+0.000 – 0.002 inches). There is thus a nominal diametral interference of 0.009 inches and a minimum diametral interference of 0.005 inches.

The area of contact between each of the four box connector fins 107 and the shrink fit area 119 of the pin tool joint pin 79 is ¾ inch × 1.875 inch or 1.4 square inches. The area of contact between each of the four pin connector fins 93 and the shrink fit area 103 of the tool joint box 77 is ¾ inch × 2-½ inch or 1.875 inches.

A typical assembly procedure for the drill stem members, having particular reference to the FIG. 2 construction but also applicable to the FIGS 3–7 construction, is as follows:

1. Pair up drill pipe and tubes according to tally sheet length.
2. Heat drill pipe tool joint box to 500°–550° F for shrink fit assembly of tube into pipe. Position pin tube connector against internal shoulder in drill pipe tool joint box.
3. Heat drill pipe tool joint pin to 400°–450° F for shrink fit assembly of box tube connector into drill pipe tool joint pin.
4. Weld box tube connector to end of tube using LH-70 electrode after preheating to 300°–350° F. Build weld flush between tube and box tube connector.
5. Kemplate connection ends of assembly.
6. Install compression seal rings.

Operation of Connector Under Load

The internal shoulders in the tool joint members cooperate with the shrink fit areas in axially positioning the tube connectors with the tool joint members as previously described. The shoulders and shrink fit areas also cause the tube to be elongated whenever the drill pipe is elongated, as when a tension load is placed on the drill stem member, thereby causing the tube to share tension load with the drill pipe. The shrink fit areas cause the tube to be compressed axially whenever the drill pipe is compressed axially, as when the drill stem member is in compression. As distinct from constructions in which the tube is connected to the pipe at only one end, there is no relative motion of a tube connector at the free end of the tube with respect to the tube connector at the fixed end of the tube in an adjacent drill stem member when the pipes of such drill stem members are elongated or compressed under load. This facilitates the use of compression seals instead of sliding seals.

Relative Sizes of Internal Shoulder and Shrink Fit Areas of Tool Joints

Various factors dictate that at the box tool joint member the shoulder be deeper and the shrink fit areas be larger than at the pin tool joint member:

a. Both the pin and the box tool joint members will, in a matched pair, have the same wall thickness at their maximum thickness portions 201, 203. The inner diameter of the box and the outer diameter of the pin will both be turned down to form tapered threaded portions.

b. Since an external shoulder 141 is formed on the exterior of the tool joint pin to provide for a rotary shouldered connection with the mouth of the tool joint box, the mouth 143 of the tool joint box has a considerable thickness.

c. The length of the threaded portion of the tool joint will be chosen so that the wall thickness of the tip 205 of the tool joint pin will also have a fair thickness for ruggedness. The bottom 207 of the tool joint box, which faces the tip 205 of the tool joint pin, may have any thickness from zero up to that of the pin tip, or more d. it is preferred to counterbore the box for a considerable distance to make the box flexible. The entirety of this counterbore area 103 is available for the shrink fit area on the fins 93 on the pin tube connector, and the deep internal shoulder at the end of the counterbore is available for axially positioning the fins on the pin tube connector. The depth of this shoulder may therefore be equal to or greater than the full thickness of the tool joint pin tip. On the other hand, as will now be explained, the depth of the shoulder in the tool joint pin tip for receiving the box tube connector is necessarily less.

e. It is desirable that the pin tool joint internal shoulder 117 not extend radially inwardly any farther than the box tool joint shoulder 207, in order not to restrict fluid flow in the annulus between drill pipe and tube. The internal shoulder in the tool joint pin must therefore be formed by counterboring, i.e. reducing the wall thickness, of the tool joint pin, rather than building up a shoulder within the tool joint pin. In order to maintain pin strength, the shoulder should not be made too deep and will in any event be less than that of the tool joint box counterbore.

f. It is to be noted that neither of the tube connectors extends axially beyond the tool joint member within which it is mounted, thereby minimizing damage when the drill stem members are disconnected. However, this also requires that the fins 107 on the box tube connector not extend all the way to the tip 205 of the tool joint pin, thereby restricting the length of these fins, at least in the direction toward the pin tip. Other factors restrict extension of these fins in the direction away from the pin tip. In particular, it is desirable not to counterbore the pin the full length of the threaded portion of the pin, for it is desirable that at least a portion of the pin (the root 209) have full wall thickness to give the threaded connection adequate strength. For these reasons the length of the centering fins 107 on the box tubing connector are shorter than the fins 93 on the pin tubing connector.

g. The number and thickness of the centering fins on both connectors are equal in order to provide equal area flow paths through the annulus of the connection.

Therefore, the shrink fit area of the box tube connector fins is less than that of the pin tube connector fins.

Support of Weight of Tube

When the drill stem members are in use, they are normally operated with the drill pipe tool joint box at the upper end, to facilitate stabbing when making up connections. In this "box up" position the weight of the tube acts in a direction from tool joint box to tool joint pin. Although the shrink fit connections between the tube connectors and tool joints are more than sufficient to support the weight of the tube, the shoulder in the tool joint box can assist in supporting the weight of the tube. For this reason there are advantages to the deep shoulder in the tool joint box. In other words, the tool joint box internal shoulder can serve not only to position the tube connector axially, as is required for the compression seal, but to support tube weight if need be. This may be viewed as a safety factor, bearing in mind the various difficulties experienced with the best of drill stem members.

Seal Ring Sections and Enclosure

FIGS. 8 and 9 show the bullet shaped cross sections of the seal rings 125, 126 in their relaxed condition. Under compression, as shown in FIG. 3, they flow to fill the space available and assume different shapes. The cross sectional area in the relaxed state is preferably slightly greater than the available cross sectional area between the ends of the tubing connection, excluding the radial space intermediate the seal ring grooves, when the drill pipe tool joints are fully made up. They are almost but not quite wholly enclosed by the tube connectors when the drill pipe tool joint members are fully made up, and extrude slightly into the tube interior and the pipe annulus. Although this configuration is preferred, other forms and cross sections of compression seals can be used.

Although a double compression seal is preferred, some of the advantages of the invention can be had using a single compression seal for each connection.

General Applicability of Invention and Modifications

While the invention has been described with respect to drill pipe, it is also applicable to drill collars, kellys, and other dual flow passge drill stem members, e.g. bits, subs, stabilizers, reamers, swivels, vibration dampeners, bumper subs, and other drill stem components including inner and outer tubular members. In some cases, e.g. a bit, the invention will be used at only one end of the member. The invention can also be applied inside out, that is with the rotary shouldered tool joint members on the tube or inner fluid conduit and the compression seal with dual elastomeric seal rings on the drill pipe or outer fluid conduit. The invention can also be used with the box connector adjacent the box tool joint member and the pin connector adjacent the pin tool joint member.

While a preferred embodiment of the construction has been shown and described, modifications thereof can be made by one skilled in the art without departing from the scope of the invention.

I claim:

1. Dual flow passage drill stem member comprising:

a tube having a flow passage therethrough, a pipe about said tube providing a flow passage between said pipe and tube, connector means at each end of said tube for making connection with correlative connector means on the tube of an adjacent drill stem member, joint means at each end of said pipe for making a rotary shouldered connection with correlative joint means on the pipe of an adjacent drill stem member, said connector means and said joint means at one end of said drill stem member being correlative to those at the other end of said drill stem member, said connector means at one end of said tube comprising a tubular pin having an annular external shoulder thereabout facing the extreme end of the pin and an external smooth cylindrical stabbing portion between said shoulder and said end of the pin and an external annular groove therearound adjacent the shoulder between the shoulder and the stabbing portion and a seal ring disposed in the groove having a protuberant portion lying against the shoulder, said connector means at the other end and said tube comprising a tubular box having an annular internal shoulder therewithin facing the mouth of the box and an internal smooth cylindrical stabbing portion between said shoulder and said mouth of the pin and an internal annular groove therearound adjacent the shoulder between the shoulder and the stabbing portion thereof and a seal ring disposed in the groove having a protuberant portion lying against the shoulder, the end of said pin and the mouth of said box of said tube connector means providing compressing surfaces which are positioned to compress protuberant portions of seal rings of correlative connector means of adjacent drill stem members when said joint means are made up with correlative joint means of adjacent drill stem members, and said protuberant portions of said seal rings being positioned to be compressed by the compressing surfaces of the connector means of adjacent drill stem members with said joint drill stem members, thereby to form a double compression seal at each made up pair of connector means, the outer diameter of said stabbing portion of the connector means pin being smaller than the inner diameter of said stabbing portion of the connector means boxy by a distance of the order of at least 0.1 inch, whereby when said connector means are box up with correlative connector means on adjacent drill stem members there is formed an annulus between each pair of pin and box stabbing portions, closed off at the ends by the seal rings to prevent the entrance of detritus when the connector means are made up, and of sufficient size to receive without harm to the stabbing portion surfaces detritus paticles of the order of at least 0.050 inch maximum transversesection, and said stabbing portions do not fret under expected bending moments of said joint means, said joint means at one end of said pipe comprising a tubular pin having an annular shoulder thereabout and an externally tapered and threaded portion between the shoulder and the extreme end of the pin and an unthreaded portion between said shoulder and said threaded portion thereof, said joint means at the other end of said pipe comprising a tubular box adapted to receive such a joint pin and the mouth of the joint box providing a shoulder adapted to engage the shoulder on such a joint pin and having an internally tapered and threaded portion adapted to engage the threaded portion on such a joint pin and having an unthreaded portion between said mouth and the threaded portion of the box thereof, said shoulders on said joint pin and joint box limiting the axial makeup of said joint pin and joint box with correlative joint means on adjacent pipes, the connector means of each end of the tube being affixed to the joint means at the same end of the member to prevent relative axial motion therebetween so that the axial makeup of said connecotr means with correlative connector means on adjacent tubes is limited by said shoulders on the joint pin and joint box of said joint means on the pipe.

2. Dual flow passage drill stem member according to claim 1 wherein in the fully made up condition of said joint means with correlative joint means on adjacent drill stem members the compressing surfaces of said pin and box connector means are axially spaced from the shoulders on the correlative connector means on adjacent drill stem members by certain distances which are less than the axial extent of the adjacent seal ring grooves, the axial extent of the protuberant portion of each seal ring is greater than said axial spacing and the cross-sectional area of each seal ring is greater than the cross-sectional area of the groove in which it is received plus the cross-sectional area of the space between the adjacent connector means shoulder and the connector means compressing surface of a correlative connector means if an adjacent drill stem member when fully made up therewith whereby in such fully made up condition the seal ring is extruded to at least substantially flush with the adjacent periphery of the connector means.

3. Dual flow passage drill stem member according to claim 1 wherein the seal rings are elastomertic and have a durometer hardness of between 50 and 75 measured on the Shore A scale, the seal rings are each of bullet shaped cross section including a base portion of rectangular cross section lying flat against the respective shoulder and a nose portion of rounded cross section, the bullet shaped section of each ring being aimed toward the end of the respective connector means, and the compressing surfaces of the connector means pin and box both flare, l.e., get larger progressing in the direction from the pin to box, thereby to engage tangentially the nose portion of the seal ring on a correlative connector means of an adjacent drill stem member when made up therewith and to tend to encapsulate the said ring between the shoulder, groove, and flare.

4. Drill stem member according to claim 1, the seal rings being identical, the seal ring on the pin tube connector being of smaller inner diameter than the outer diameter of the part of the pin adjacent such groove thereon, whereby in assembly it is stretched to pass over such pin part and then contracts within the pin groove the outer diameter of the seal ring in the box tube connector being of larger diameter than the inner diameter of the part of the box adjacent said groove therein, whereby in assembly it is compressed to pass within such box part and then expands into the box groove.

5. Connection for dual conduit drill stem members comprising:

a first drill stem member and a second drill stem member, each of said drill stem members including an inner element having a flow passage therethrough, an outer element about said inner element and providing an annular flow passage between said inner and outer elements, connector means at one end of said inner element of each said drill stem member for making connection with correlative connector means on the inner element of the other of said members and to communicate said flow passages of said inner elements for the flow of fluid therebetween, joint means at one end of said outer element of each said drill stem member for making a rotary shouldered connection with correlative joint means on the outer element of the other of said member and to communicate said annular flow passages for the flow of fluid therebetween, said one end of said outer element of each drill stem member at which said joint means is located being at the same end of said drill stem member as said one end of the inner element, said joint means on one of said members being a box having an internal tapered thread, said joint means on the other of said members being a pin having an external tapered thread, at least a portion of said thread on the pin being adapted to mate with at least a portion of the thread on the box when said joint means are connected together, said box having an annular shoulder axially spaced from the portion of the thread thereon that is engageable with the pin thread, said pin having an annular shoulder axially spaced from the portion of the thread thereon that is engageable with the box thread, said shoulders being engageable to form a seal when said joint means are made up, said connector means on one of said members being a box having an internal annular groove spaced axially from the end of the box and an annular shoulder facing toward the end of the box and located adjacent said groove on the side of the groove opposite from the end of the box and extending radially inwardly farther than the sides of said groove, and an annular seal disposed in said groove and having a protuberant portion extending radially from the groove alongside of the last shoulder, said connector means on the other of said members being a pin having an external groove spaced axially from the end of the pin and an annular shoulder facing toward the end of the pin and located adjacent said external groove on the side of the external groove opposite from the end of the pin and extending radially outwardly farther than the sides of said groove, and an annular seal ring disposed in said external groove and having a protuberant portion extending radially from the external groove alongside of the last said shoulder, said connector means pin being adapted to be received in said connector means box when said joint means are made up and having a length sufficient for its said end to compress by a predetermined fixed amount the seal ring in the grove in the connector means box against the shoulder of the connector means box, the connector means box having a length sufficient for its said end to compress by a predetermined fixed amount the seal ring in the groove in the connector means pin, thereby to form a double compression seal between said connector means pin and box with a predetermined fixed amount of compression thereof, said connector means pin and box being radially spaced apart when said joint means are made up, allowing flexure of said joint means without fretting of said connector means pin and box, said connector means being affixed to said joint means to prevent axial motion of the connector means relative to the joint means, said connector means pin and box being rigidly fixed against axial motion relative to each other by the make up of said joint means forming a rotary shouldered connection.

6. Connection according to claim 5 wherein the seal rings are of bullet shaped cross section including a base portion of rectangular cross-section lying flat against the respective shoulder and a nose portion of rounded cross section, the bullet shaped cross-section of each ring being aimed toward the end of the respective connector means, the connector means pin and box having ends that flare when progressing axially in the direction from pin to box.

7. Connection according to claim 5, the outer diameter of the connector means pin being smaller than the inner diameter of the connector means box by a distance of the order of 0.05 inch or greater, forming an annulus therebetween of sufficient size to receive without harm to the pin and box surface detritus particles of the order of at least 0.050 inch maximum transverse dimension, said seal rings being elastomeric and having a durometer hardness of between 50 and 75 measured on the Share A scale, said seal rings bridging across the ends of sid annulus.

8. Connection according to claim 5, said seal rings being made of elastomeric material, said seal rings being identical, the seal ring on the pin connector means, when the ring is unstressed, being of smaller inner diameter than the outer diameter of the part of the pin adjacent said groove thereon, whereby in assembly it is stretched to pass over such pin part and then contracts into the pin groove, the outer diameter of the seal ring in the box connector means being of larger diameter than the inner diameter of the part of the box adjacent said groove therein, whereby in assembly it is compressed to pass within such box part and then expands into the box groove.

9. Connection according to claim 5, each connector means being provided with centralizing means to center it coaxially within the adjacent joint means, the centralizing means being shrink fitted within the joint means, thereby to insure concentric engagement of the connector means pin and connector means box and their seal rings, each joint means having internal shoulder means against which the centralizing means of the adjacent connector means is axially positioned to establish the said predetermined fixed distance of the shoulder on each connector means from the end of the other connector means when said joints are made up.

* * * * *

UNITED STATES PATENT AND TRADEMARK OFFICE

CERTIFICATE OF CORRECTION

PATENT NO. : 3,998,479

DATED : DECEMBER 21, 1976

INVENTOR(S) : WILLIAM W. BISHOP

It is certified that error appears in the above-identified patent and that said Letters Patent are hereby corrected as shown below:

Column 1, line 38, change "useag" to -- usage --.

Column 1, line 50, change "rouch" to -- rough --.

Column 2, line 50, change "collapses" to -- collapsed --.

Column 3, line 32, after "with" insert -- the --.

Column 3, line 41, after "Summarizing" insert -- , --.

Column 4, line 1, after "joints" insert -- and --; after "using" delete "and".

Column 7, line 7, change "extend" to -- extent --.

Column 7, line 11, change "Compression" to -- compression --.

Column 7, line 40, after "at" delete "0300".

UNITED STATES PATENT AND TRADEMARK OFFICE

CERTIFICATE OF CORRECTION

PATENT NO. : 3,998,479

DATED : DECEMBER 21, 1976

INVENTOR(S) : WILLIAM W. BISHOP

It is certified that error appears in the above-identified patent and that said Letters Patent are hereby corrected as shown below:

Column 7, line 42, after "to" insert -- also --.

Column 11, line 33, change "passge" to -- passage --.

Column 12, line 33, change "boxy" to -- box --.

Column 12, line 35, change "box" to -- made --.

Column 12, line 42, change "paticles" to -- particles --.

Column 13, line 24, change "elastomertic" to -- elastomeric --.

Column 15, line 25, change "sid" to -- said --.

Column 2, line 35, change "Durometer" to -- durometer --.

Column 3, line 66, change "Contuit" to -- Conduit --.

UNITED STATES PATENT AND TRADEMARK OFFICE

CERTIFICATE OF CORRECTION

PATENT NO. : 3,998,479

DATED : DECEMBER 21, 1976

INVENTOR(S) : WILLIAM W. BISHOP

It is certified that error appears in the above-identified patent and that said Letters Patent are hereby corrected as shown below:

Column 7, line 13, change "protubrant" to -- protuberant --.

Column 12, line 67, change "connecotr" to -- connector --.

Column 13, line 34, change "l.e." to -- i.e. --.

Column 13, line 47, after "groove" insert -- , --.

Signed and Sealed this

Twenty-second Day of March 1977

[SEAL]

*Attest:*

RUTH C. MASON
*Attesting Officer*

C. MARSHALL DANN
*Commissioner of Patents and Trademarks*